United States Patent [19]

Seckinger

[11] Patent Number: 4,658,105

[45] Date of Patent: Apr. 14, 1987

[54] ELECTRICAL CONTACT MEANS FOR A LOCK CYLINDER WITH AN ELECTRONIC/MECHANICAL KEY

[75] Inventor: Erich Seckinger, Wallisellen, Switzerland

[73] Assignee: Bauer Kaba Ag, Wetzikon, Switzerland

[21] Appl. No.: 753,776

[22] Filed: Jul. 11, 1985

[30] Foreign Application Priority Data

Aug. 10, 1984 [CH] Switzerland ..... 03950/84

[51] Int. Cl.[4] ..... H01R 31/08

[52] U.S. Cl. ..... 200/43.05

[58] Field of Search ..... 200/43.08, 43.05, 43.06; 70/277

[56] References Cited

U.S. PATENT DOCUMENTS 3,187,123 6/1965 Anthony ..... 200/43.06
3,854,120 12/1974 Matto et al. ..... 200/43.05
3,983,354 9/1976 Gammie et al. ..... 200/43.08
4,527,024 7/1985 Lai ..... 200/43.08

FOREIGN PATENT DOCUMENTS 2389988 1/1979 France ..... 200/43.08

*Primary Examiner*—Stephen Marcus
*Assistant Examiner*—Renee S. Luebke
*Attorney, Agent, or Firm*—Walter C. Farley

[57] ABSTRACT

A locking cylinder has contact means with a contact support, including one or more contact elements. Each contact element partially surrounds the circumference and is fixed and secured against axial displacement, but while allowing partial radial movement. A concentric contact guidance member with contact guides for the contact elements is rotatable with respect to a common centre but is fixed with respect to the contact support in the axial direction. The contact elements can be brought into operative connection with these contact guides.

12 Claims, 9 Drawing Figures

ELECTRICAL CONTACT MEANS FOR A LOCK CYLINDER WITH AN ELECTRONIC/MECHANICAL KEY

The present invention relates to the field of safety technology and applies to an electrical contact means for a lock cylinder with mechanical locking means, particularly a cylinder for the use of an electronic/mechanical flat key.

BACKGROUND OF THE INVENTION

The prior art covers mechanically functioning cylinders, with radially functioning tumbler pins, which are controlled by suitable bores or variously shaped depressions in an associated flat key. From the mechanical precision standpoint, these cylinders have now been developed to a very high level. As a result of new computer-controlled milling methods, the number of permutations of a modern flat key is so high that it is now scarcely possible for two keys to undesirably have the same opening code or the same control topography. In addition, modern flat keys are the product of logical miniaturization, so that it is no longer readily possible to extend locking hierarchies, i.e. organizational safety means.

The prior art also covers electronically functioning locking systems which, as such, allow an extension of the organizational requirements with respect to said key hierarchies. Of particular interest is the possibility of time limitations regarding the opening function. Thus, access is only possible at certain times and from the organizational standpoint increases the security, which is inherent in lock technology.

Cylinders and keys having mechanical and electrical locking means in the same system are also known. Whilst the mechanical locking part of such a system can be highly developed, the associated electronics are not highly developed because of the minimal experience level in this field. This is illustrated by the fact that electronic locking systems still always drift towards reading card methods or, from the design standpoint, lock-like actuating elements are offered for the electronics, i.e. solely electronic solutions. The problem in connection with optical solutions is that energy must be provided for the transmitter and receiver, which means that the key, which is a mass-produced article, must also be provided with a power supply. In the inductive solution, as a result of the electromagnetic transfer resistances, such as air gaps and the unavoidable dissipation losses, a great deal of operating energy must be expended, whilst in the galvanic solution the problem is linked with the limits concerning the miniaturization for electromechanical contacts, i.e. for the purely galvanic or direct contacts between key and e.g. cylinder. In addition, the key and lock are mass-produced articles, which must operate in a highly precise manner, must be functionally reliable, have a long-life, be robust, inexpensive, etc, requirements that a mechanical locking system is now able to satisfy following a long development period. If these requirements are transferred to the electrical part of a locking system, then problems occur, to which no solutions are available to the expert in this field.

SUMMARY OF THE INVENTION

An object of the present invention is to provide an electrical contact means in a cylinder which, despite miniaturization of the contact, spacings or contacts, has an operational reliability comparable with the mechanical locking part, despite there being no device in the vicinity of the key channel for protecting said contacts during normal rough use.

This object is achieved by an electrical contact means with a contact support, on which one or more contact elements are axially juxtaposed and only rest partially thereon with respect to the circumference, being fixed and secured against axial displacement and turning, whilst being partially radially movable and with a concentric contact guidance part with contact guides for the contact elements rotatable with respect to a common centre, but fixed axially with respect to the contact support, whereby the contact elements can be brought into operative connection with these contact guides.

According to a preferred embodiment, the contact guides are formed on the movable contact guidance part as a circumferential slot with a non-uniform depth around the circumference. This non-uniform depth of the circumferential slot, in which the contact ring guided therein slides with a relative movement, serves as a control for the radial displacement of the guided contact.

In a further preferred embodiment, split contact rings are fixed on the outer circumference of the contact support against axial movement and are secured against rotation, the contact support having at least one window-like opening for operative engagement of the contact rings fixed thereon at at least one point of the circumference with the slots of the rotatably mounted contact guidance part.

According to a further preferred embodiment, the rotatable contact guidance part is circumferentially split. The width of the cutout corresponds essentially to the width of the flat key with the electrical key contacts arranged thereon.

According to a further preferred embodiment, the sliding slot on the movable contact guidance part is designed in such a way that the legs of a split contact ring can be raised in an inoperative position and lowered on to the key contacts in an operative position.

According to yet another preferred embodiment, each of the split contact rings is provided with an additional bulge for soldering purposes located assymetrically relative to the legs or a plug pin for a plug or other direct connection elements located symmetrically.

According to another preferred embodiment, the contact support has two window-like openings, which are not directly opposite each other, for the passage of the two contact legs of the split contact ring and the guidance slot on the rotary contact guidance part with the cutout for the key contacts has on both sides towards the cutout a lowering of the slot base for contact leg control purposes.

According to yet another preferred embodiment, the juxtaposed contact rings are pressed into the all-round slots on the outer circumference of the contact support by a circular segmental clasp drawn on to the same and with a cutout for the solder bulges of the contact rings and are fixed against rotation and displacement in the axial direction and partly in the radial direction.

BRIEF DESCRIPTION OF THE DRAWINGS

The invention is described in greater detail hereinafter relative to non-limitative embodiments and the attached drawings, wherein.

DESCRIPTION OF THE PREFERRED EMBODIMENTS

Figure 1:
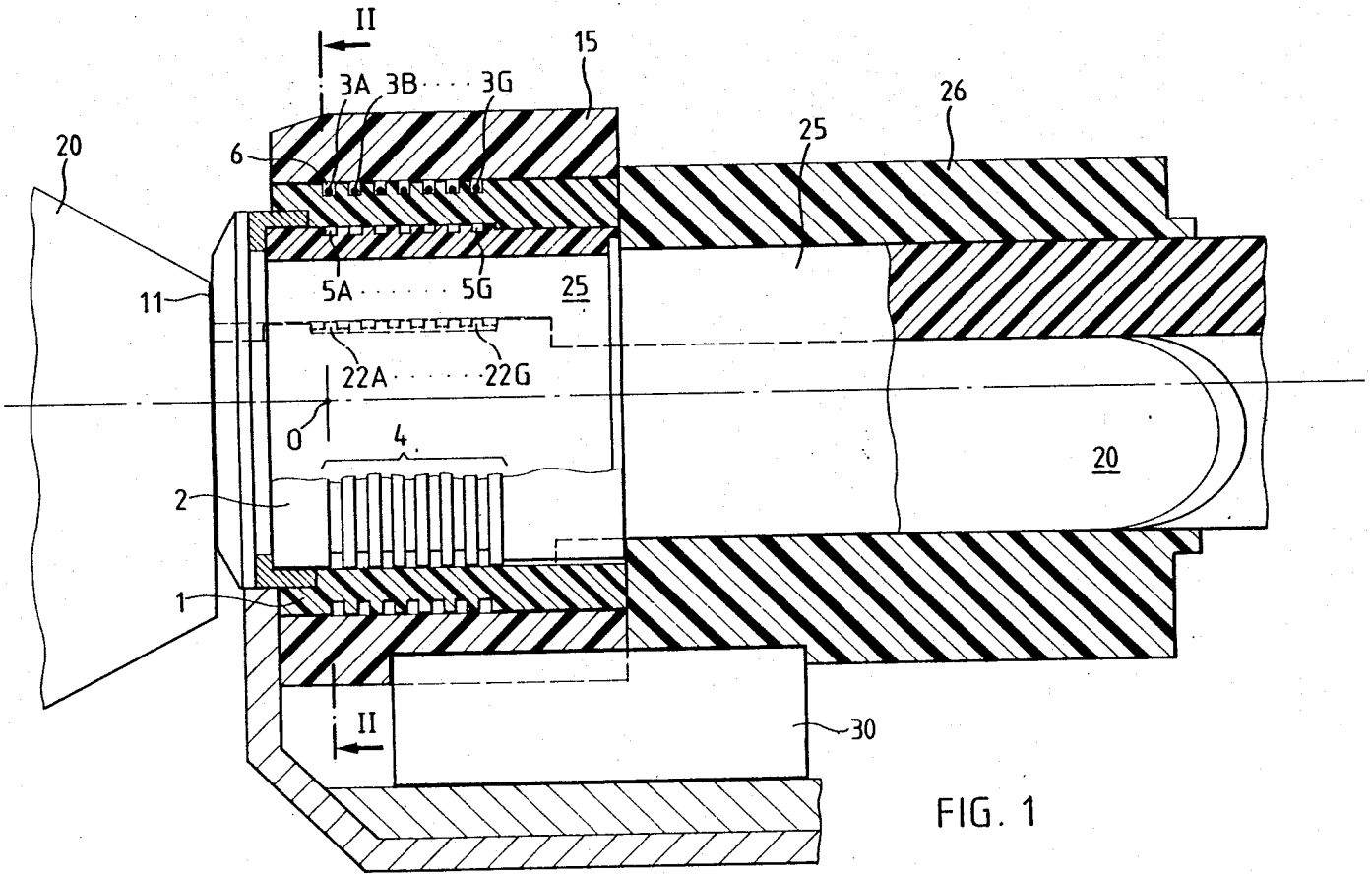
FIG. 1 is a longitudinal section through a cylinder with an inserted key and is the electrical contact means according to the invention.

FIG. 1 shows in longitudinal sectional form the electrical contact means in its surroundings, namely in a cylinder with an inserted mechanical/electronic key. The mechanical part has as its main elements the cylinder stator 26, with the cylinder rotor 25 rotatable therein, in which it is possible to see the shaft of the inserted flat key 20. Bores for tumblers, the actual tumblers and tumbler cavities in the key shaft have been omitted. Turning the contact means relative to stator 26 is prevented by a cylindrical part 30 between the contact means and the stator. At the left of FIG. 1, it is possible to see part of the bit of the flat key 20, which is constructed in such a way that it abuts a clearly defined stop 11 on rotor 25 which is rotatable with the key. This stop defines the axial position of key contacts 22A . . . 22G when the key is fully inserted. In the present case, these contacts are arranged between the bit and the portion of the key shaft which is provided with the recesses for the tumblers.

Drawn concentrically on to rotor 25, it is possible to see the contact guidance part 2 with contact guides 4, which in this embodiment are in the form of sliding slots 5A to 5G for the free contact legs of open or split contact rings, to which further reference will be made hereinafter. Between the rotor 25 and the contact guidance part 2 there is no relative movement in operation. However, it can be designed in rotationally positionable manner for certain embodiments, because it is not fully symmetrical orthogonally to the rotation axis. A contact support 1 with peripherically provided contact rings 3A . . . 3G is arranged in a fixed position relative to stator 26 and in a concentrically and slidingly movable manner around contact guidance part 2. In the present embodiment, contact rings 3A–3G are received in a succession of axially spaced, circumferential slots and are prevented from movement by a clasp 15 pressing against certain points.

Figure 2:
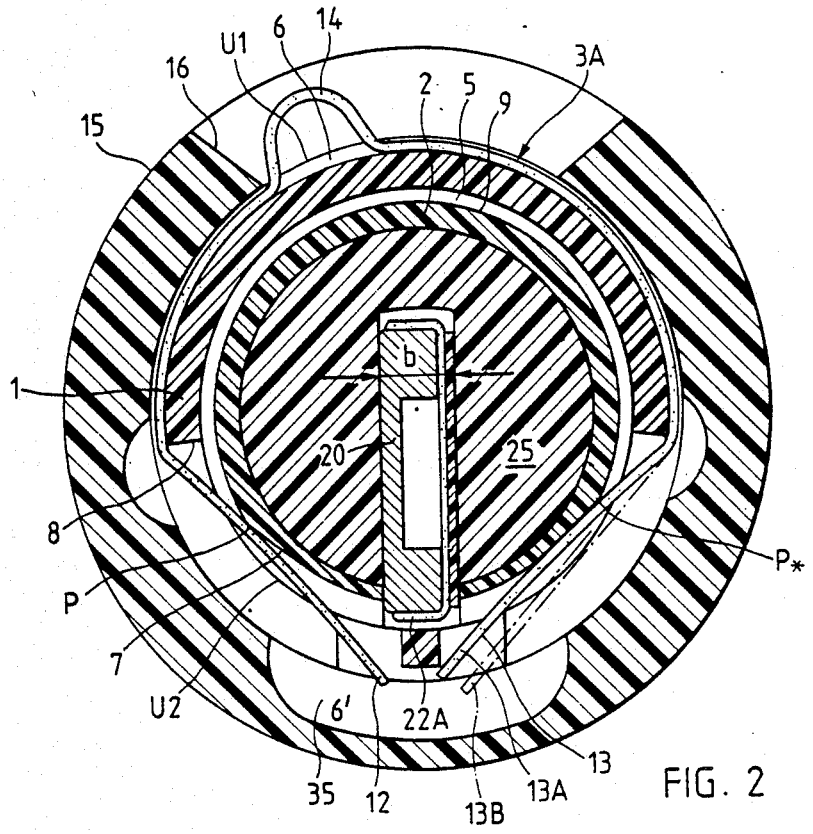
FIG. 2 is a section along line II—II of FIG. 1.

FIG. 2 is a transverse sectional view in the direction toward the key bit, i.e. viewed outwardly from the cylinder. Key 20 is inserted into a key channel of width B formed in rotor 25. The section passes through the electrical contact ring 3A on contact support 1 which is fixed to the stator and also passes through the electrical contact 22A on key 20. In the illustrated turning key, contact 22A is exposed to both of the narrow key faces. The contact guidance part 2 is arranged on the rotor circumference and the free contact legs 12, 13 of contact ring 3A slidably engage in its slot 5. The bottom 9 of sliding slot 5 is in the form of a control link 7 with a depression beginning at point P and formed by a decrease in the radius. Contact legs engage the contact guidance part through window-like openings 8 in contact support 1. As a result of very close juxtapositioning of the contacts on the key in the "electrical part" of the cylinder, there is a need for axial miniaturization, so that operationally reliable and simultaneous contact is required, without reciprocal contact despite the relatively long radial spring excursion by a complete contact row 3A . . . 3G/22A . . . 22G with a very long contact part, i.e. large contact angle (reading time and possible writing time by varying rapid key rotation by the user until the influencing of the lock (not cylinder) mechanism).

The operational reliability of contacting is fundamentally dependent on the transfer resistance of the contact pairs, which is a function of the contact pressure, surface charcteristics, contact material, etc. The unidimensional miniaturization leads to a reduction in the surface size in the second power and a reduction of the volume in the third power. Suddenly vital importance is attached to environmental influences in connection with miniaturization, which could previously be ignored. In the present case, this inter alia consists of the dirtying in daily use of the inwardly (key channel) unprotected contact rings. This dirtying or contaminating action, which in the case of adequately high contact cross-sections of resilient contacts could at the most influence the transfer resistance, in the presently miniaturized case impairs the necessary mobility of the contacts, because the mechanically slightly loadable contacts must necessarily be protected against any displacement from their "operating area" by supporting means, with equally fine guides. Rake-like guides, which prevent an axial displacement but allow a radial displacement, all failed as soon as dirt particles began to accumulate in the guides. It was also difficult to produce such sensitive devices, which are generally constituted by possibly reworkable plastic injection mouldings. High part rejection rates made use more expensive and the operational reliability was always a little doubtful, this being increased by the fact that the plastic parts participating in the miniaturized solution gradually started to distort during their life. Some of the carefully supported contacts consequently started to stick under such influences and the electrical system failed.

To obviate this, according to a generalised inventive procedure, the delicate, trouble-inducing constructional developments in connection with contact positioning and contact guidance on the contact support can be physically eliminated and their functions can be transferred to a movable contact guidance part with non-critical construction. This has the advantage of preventing dirt accumulation in the "opening area" of the particular contact which, due to the prevention of a possible breaking action, ensures a uniform contact pressure on the contact legs and also has the advantage that the contact legs are cleaned in operation. There is the further advantage of a radial contact control possibility, which can e.g. also be used for increasing the life of the contacts by optimizing the mechanical loading, their moving out of "danger zones" during operation, i.e. the instant at which the key is inserted in the channel. Quite apart from this, the production of the equipment parts according to the invention as a mass-produced product without any need for reworking is cheaper and the no longer sensitive parts are operationally reliable throughout their life.

Thus, e.g. rake-like guides are omitted in the contact support 1 fixed to the cylinder stator and in place thereof is merely provided a window-like opening 8. There are two such openings in the present case and above them the contact rings 3 or contact legs 12, 13 freely pass over the same. Here, in each case one contact leg is used for a separate functon description. As a rule, the embodiments are symmetrical with respect to the contact legs.

The sliding slots 5 of contact control part 2 are arranged rotatively, being axially oriented under opening 8 and aligned with retaining slots 6 on contact support 1. As a function of the rotation direction, the guide slides here passed one of the fixed contact legs 12, 13, the sliding slot bottom 9 in the form of a control link 7 (although this is not necessarily so) radially deflects out the contact leg, e.g. at point P. Control link 7 can be represented by a specially shaped topography of the sliding slot bottom 9 on a line P—P*. This is represented at the twice shown position 13A, 13B of contact leg 13. The extended contact leg 13 in position 13B is e.g. in the maximum deflected spring position by modifying the sliding slot bottom 9 at point P*, so that the mximum spring excursion e.g. runs from position 13A to position 13B. The contact leg 12 is in a type of parking position protected from the traffic in the key channel and by modifying the link 7 is raised somewhat at point P. This lowering at point P in the case of even slight turning of the key enables the contact to enter another position, the operating position, in which it engages on the key contact 22 which is sliding past. Any dirt particles which have got in as a result of the relative movement between sliding slot 5 and contact leg 12 or 13 is simultaneously conveyed away and accumulated in a special cavity 35 provided for this. As there are no fixed parts in the "operating area" of the individual contacts 3A . . . 3G, no dirt can be deposited thereon in such a sensitive zone and which could prevent the contact rings or legs from moving freely.

For completeness, FIG. 2 shows a split contact ring 3A with functionally adapted contact legs and a bulge 14 for soldering purposes. A suitably shaped clasp 15 presses the contact ring row 3A . . . 3G into the retaining slots 6 of contact supports 1, but leaves space for the resilient movement of contact legs 12, 13 and also has a cutout 16 for the solder bulges 14A . . . 14G. It is also possible to see a special asymmetrical shaping of the contact rings, so that when rotated by 180°, there is an interlocked arrangement of the solder bulges, which facilitates the soldering of the closely juxtaposed contact rings. Instead of being provided with terminals for solder connections, the contact rings can also be provided with other features of direct connection methods e.g. plug contacts for a plug, clamp or cold welding-like connections, etc.

It is clear that the measures according to the invention permit considerable optimization regarding the shaping of the contacts and the control links. As a result of the now free operating area for the contacts, sequences of motion can be provided of the type which were not hitherto possible. Special contact spring and control link configurations make it possible to satisfy demands for a maximum contact angle, relative to the key rotation on operating the cylinder, in order e.g. to reliably determine the processor ready and the following R/W sequence when the processor has just been switched on.

Figure 3:
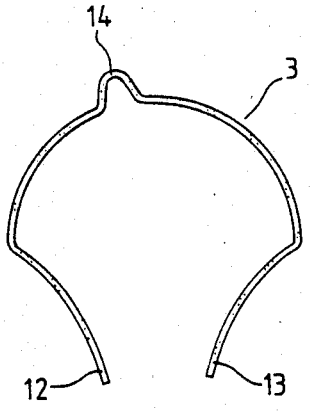
FIG. 3 an embodiment of a contact ring usable in the structure of FIGS. 1 and 2.
Figure 4:
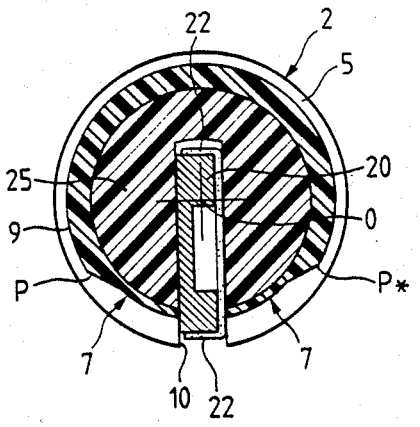
FIG. 4 is a transverse sectional view of an embodiment of the movable contact guidance part.
Figure 5:
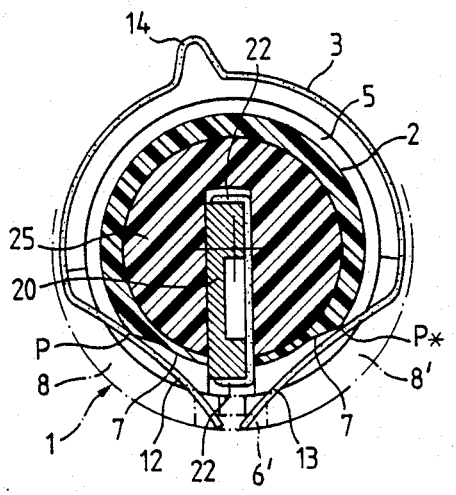
FIG. 5 is a transverse sectional view showing the function of the embodiment combining the structures of FIGS. 3 and 4 in the key insertion position.
Figure 6:
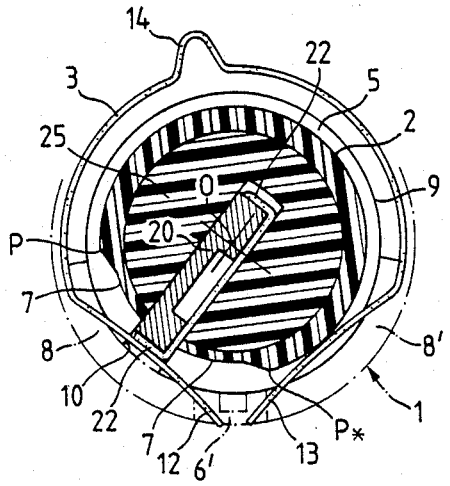
FIG. 6 is a view similar to FIG. 5 after a clockwise one-eighth turn of the key.

An embodiment for this is shown by FIGS. 3 and 4. FIGS. 5 and 6 show the functional sequence of the contact movement in two of the possible key positions. Contact rings 3 is equipped with a solder bulge 14 and concave contact legs 12,13. The contact guidance part 2 (FIG. 4) with the sliding slot 5 placed on cylinder rotor 25 surrounds key 20 with key contacts 22. The sliding slot bottom 9 is significantly lowered at points P—P* to below the level of key contacts 22 of the inserted key and remains on the lowered link bottom up to cutout 10 of guidance part 2 for the passage of the key. In the narrower sense, path P—P* is the control link 7 for lowereing the contacts from their inoperative position on to the key contacts 22, i.e. the operative position.

A represented embodiment is intended for a turning key. Thus, on both narrow sides, the key carries contacts 22, which are interconnected in the manner shown in FIG. 2. The left/right symmetry of control link 7 make the cylinder for the electrical part rotation direction-independent i.e. it is unimportant to which side the key is turned for opening or closing following the insertion thereof.

FIGS. 5 and 6 are now used for showing the function in two operating positions and they only show the parts necessary for explaining the function. The proportions are in part exaggerated, e.g. no constructional conclusion can be drawn from the relative sizes of the key channel/contacts ring thickness. In general, the contact springs are very thin, having an approximate diameter of 30 to 35/100 mm, the key channel being 6 to 8 times wider. The contact support 1 is indicated in such a way that the window-like openings 8, 8' are functionally apparent. The contact ring 3 is shown around the contact guidance part 2, but in actual fact it is positioned on contact support 1, as shown in FIG. 2. FIG. 5 shows rotor 25 with key 20 in its insertion position. However, it has not yet been decided to which side the rotor 25 with the contact control part 2 is to be turned. Contact ring 3 remains unchanged in its position relative to the stator. The contact legs 12, 13 passing out of the retaining slot on the contact support 1 at the particular window edge 8, 8' engage with the sliding slot 5, e.g. in such a way that they rest with the necessary pretension for the requisite contact pressure on the sliding slot bottom 9. At the other window edge, the leg ends are again located in a circumferentially aligned retaining slot part 6' of the contact support 1. Thus, contact ring 3 with contact legs 12, 13 is secured against axial displacement over its entire length. A reciprocal contacting of the contact legs is also prevented in the free windows 8, 8' as a result of the continuous action of sliding slots 5.

FIG. 6 shows the position of key contacts 22 with respect to contact leg 12 following a clockwise one-eigth turn. The lowered link bottom 7, after point P has been turned away clockwise, also allows movement of contact leg 12 towards the rotation centre 0, so that it now contacts key contact 22 and consequently closes the galvanic circuit. The other contact leg 13 remains in its inoperative position, because there has been no change with respect to the centre of rotation of the sliding slot bottom 9. The ends of the two contact legs naturally remain undisplaced in their lower guide. On observing the position of contact leg 12 relative to the two links 7 or to link P—P*, it can be seen that the contact legs must be engaged over a certain angle, i.e.

sometime before reaching the one-eighth turn position, and must remain engaged over roughly the same angle on further turning until returned to its inoperative position at point P*. This leads to a relatively large contact angle and consequently directly to a data reading time related to an average key rotation speed. The contact pressure can be set by bending in the contact leg or by the concave shaping thereof. The contact time is increased by path-optimised curves.

It is also pointed out that the symmetrical engagement of the link from P to P* was selected as a result of the equivalents of the rotation direction. However, the link should also extend on either side of cutout 10 in any other case. However, then spacings P and P* need not be the same with respect to the centre of cutout 10.

Figure 7:
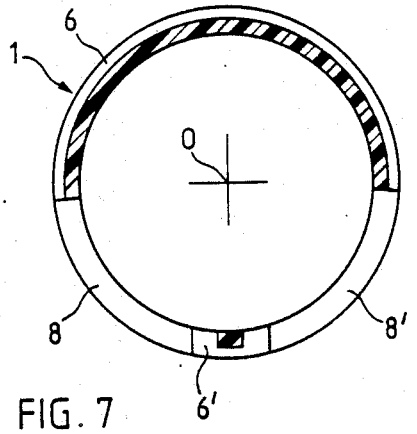
FIG. 7 is a section through one of the retaining slots of the contact support.
Figure 8:
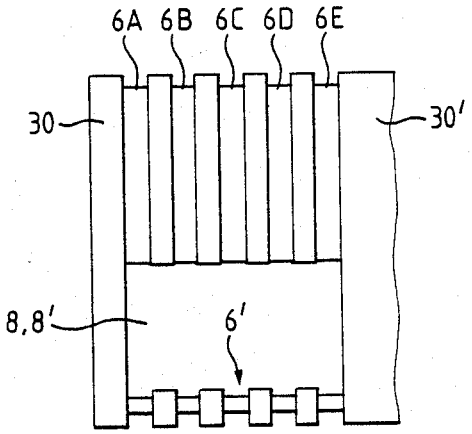
FIG. 8 is a lateral projection of the contact support showing the retaining slots and a window-like opening for the engagement of the contact elements in the movable contact guidance part.

FIGS. 7 and 8 show the contact support 1 in section through one of the retaining slots 6 and in lateral projection. The contact guidance part 2 inserted in the hollow cylindrical contact support 1 rotates about the common rotation centre 0. The retaining slots 6 are completely interrupted by the window-like openings 8, 8', so that the contact ring 3 inserted therein is only partly supported by contact support 1. One of the window-like openings can be clearly seen in FIG. 8. In this projection the retaining slots 6A to 6E are shown and on either side the part is defined by terminal webs 30 and 30'. The contact leg over the window-like opening 8', apart from radial deflections, remains in position, i.e. the contact leg end remains supported in the retaining slot web parts 6'. If it is radially raised therefrom, it is only by contact guidance part 2 which takes over the securing and guidance of the contact leg. Thus, at all times and in any key turning position, the contact ring is secured against uncontrolled positional changes.

Figure 9:
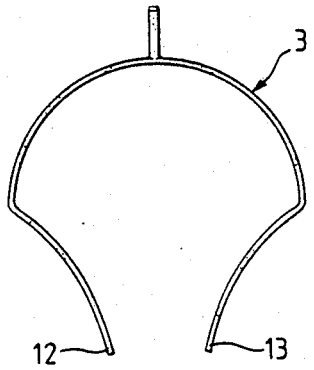
FIG. 9 is another embodiment of a contact ring.

Finally, FIG. 9 shows an embodiment of an open key ring 3, which has a plug pin symmetrically to the two contact legs 12, 13. Thus, the contacts do not have to be brazed and can be connected to the evaluation circuit by a plug. Thus, the electrical contact part can be interchanged without a soldering process.

I claim:

1. A lock cylinder for receiving a key having mechanical and electronic coding thereon and having electrical key contacts exposed along an edge thereof, said cylinder having contact means for making electrical contact with the contacts on the key and electronic evaluation means for responding to the coding, the contact means comprising a plurality of electrical contacts each having contact legs;

a contact support body having a central axis and including means for carrying said plurality of electrical contacts in a substantially uniform, axially spaced array on said support so that said electrical contacts are restrained against axial and rotational movement and so that said legs are radially movable, and a contact guidance member concentrically rotatable within and axially fixed relative to said contact support body, said guidance member having a plurality of contact guides for axially guiding said contact legs, and a guide slot for receiving said key with said exposed key contacts thereon in position to electrically contact said contact legs as said guidance member is rotated by said key.

2. A cylinder according to claim 1 wherein said contact guides comprise a plurality of circumferential slots on the exterior of said guidance member for slidingly receiving said contact legs.

3. A cylinder according to claim 2, wherein each of said circumferential slots includes a noncircular outwardly facing bottom surface against which one of said contact legs rides, said bottom surface acting to radially deflect said leg.

4. A cylinder according to claim 3 wherein each of said bottom surfaces of said circumferential slots is shaped to move its associated contact leg outwardly to an inoperative position in one rotational position of said guidance member and to permit said leg to move inwardly to an operative position in a second rotational position.

5. A cylinder according to claim 3 wherein each of said electrical contacts comprises a split ring substantially surrounding a portion of said contact body.

6. A cylinder according to claim 5 wherein said contact support body includes at least one window-like opening therethrough through which one of the legs of said electrical contact can engage one of the key contacts as said guidance member is rotated.

7. A cylinder according to claim 6 wherein said guidance member includes means defining an opening therethrough having a width substantially corresponding to a narrower width of the key with the key contacts thereon.

8. A cylinder according to claim 7 wherein each of said bottom surfaces of said circumferential slots is shaped to move its associated contact leg outwardly to an inoperative position in one rotational position of said guidance member and to permit said leg to move inwardly to an operative position in a second rotational position.

9. A cylinder according to claim 8 wherein each of said electrical contacts includes a soldering bulge located thereon asymmetrically relative to said legs.

10. A cylinder according to claim 8 wherein each of said electrical contacts includes a plug pin for receiving a plug, said pin being positioned symmetrically relative to said legs.

11. A cylinder according to claim 8 wherein said contact support body includes two window-like openings separated by significantly less than 180° for admitting both legs of said electrical contacts, said bottom surfaces of said slots being shaped to permit movement of said legs through said openings.

12. A cylinder according to claim 8 and further including a circular clasp surrounding said contact support body and pressing said electrical contacts against said body, and means for restraining said clasp against axial and rotational movement.

* * * * *